US008104395B2

(12) United States Patent
Ran

(10) Patent No.: US 8,104,395 B2
(45) Date of Patent: Jan. 31, 2012

(54) SAFETY DEVICE FOR RIFLE OR THE LIKE

(76) Inventor: Xiaocheng Ran, Alhambra, CA (US)

( * ) Notice: Subject to any disclaimer, the term of this patent is extended or adjusted under 35 U.S.C. 154(b) by 46 days.

(21) Appl. No.: 12/584,458

(22) Filed: Sep. 4, 2009

(65) Prior Publication Data

US 2011/0056366 A1 Mar. 10, 2011

(51) Int. Cl.
*F41H 5/12* (2006.01)

(52) U.S. Cl. ..... 89/36.06

(58) Field of Classification Search ..... 89/36.06, 89/36.01, 36.02, 36.05, 36.07; 428/911
See application file for complete search history.

(56) References Cited

U.S. PATENT DOCUMENTS

| | | | | | |
|---|---|---|---|---|---|
| 295,013 | A * | 3/1884 | Hunter | 89/36.06 |
| 1,279,930 | A * | 9/1918 | Stroud | 89/36.06 |
| 1,301,293 | A * | 4/1919 | Molvig | 89/36.06 |
| 1,308,286 | A * | 7/1919 | Korn | 89/36.09 |
| 1,320,888 | A * | 11/1919 | Miller et al. | 89/36.06 |
| 1,430,661 | A * | 10/1922 | Lewis | 89/193 |
| 1,555,027 | A * | 9/1925 | Rose | 89/14.3 |
| 2,306,708 | A * | 12/1942 | Mendel | 42/106 |
| 3,624,238 | A * | 11/1971 | McKenzie | 428/81 |
| 4,358,984 | A * | 11/1982 | Winblad | 89/36.08 |
| 7,658,302 | B2 * | 2/2010 | Berman | 222/79 |
| 2002/0124717 | A1 * | 9/2002 | Torres | 89/36.05 |
| 2008/0087684 | A1 * | 4/2008 | Koshimoto | 222/192 |

* cited by examiner

*Primary Examiner* — Michelle Clement
(74) *Attorney, Agent, or Firm* — Raymond Y. Chan; David and Raymond Patent Firm

(57) ABSTRACT

A safety device comprises a shield, and an supporting frame. The shield is fixed on the body of the rifle to protect the shooter's face. The supporting frame is adapted to support the shield against the impact of a bullet shooting on the shield or other attack.

11 Claims, 7 Drawing Sheets

SAFETY DEVICE FOR RIFLE OR THE LIKE

BACKGROUND OF THE PRESENT INVENTION

1. Field of Invention

The present invention relates to a safety device, and more particularly to a safety device for people using a rifle or the like.

2. Description of Related Arts

All of the currently used rifles and small arms need the user to aim directly for shooting the target, which means the shooter must align the target and the barrel in a straight line using his eye. To do this, the shooter has to place his eye behind the rear sight with the barrel of the rifle facing the target. At this moment, at least half of the shooter's face has to be exposed without cover. Currently, a soldier's body is protected by helmet and bullet-proof vest. But because the soldiers need to aim their weapons, there is not protect for the faces. This will introduce a chance for the shooter to be hurt in a danger battle field.

Some shields are used for protecting the shooter, but generally they are designed for heavy duty machine guns which are carried by vehicles or fixed on a frame. These shields are not and are not portable. They are not suitable for rifles and small arms. These shields are mostly designed for particular guns and can not be used for different arms. Also, the material of these shields is metal which is heavy and not transparent. The shooter can only use the pre-opened aiming area for aiming and observing. The design of the aiming area largely limits the view field of the shooter. And still, it is not covered and the shooter can still be hurt.

SUMMARY OF THE PRESENT INVENTION

The main object of the present invention is to provide a safety device to protect the shooter of a rifle.

Another object of the present invention is to provide a safety device which is suitable for different types of arms.

Another object of the present invention is to provide a safety device which doesn't affect the observation of the shooter.

Another object of the present invention is to provide a safety device which is portable.

Another object of the present invention is to provide a safety device which is convenient to use.

In order to accomplish the above objects, the present invention provides a safety device for rifle or the like, comprising:

a shield, which is made of transparent bulletproof material, having a shielding area adapted for covering at least a face portion of a shooter; and a supporting frame which comprises a hub locker adapted for locking at a barrel of said rifle, and a shield supporter extended from the hub locker to support the shield at the barrel at a position that the shield is radially extended from the barrel of the rifle, in such a manner that the shield forms a face guard for the shooter during shooting operation while the shooter is able to carry the rifle with the shield and to see through the shield for aiming a target.

These and other objectives, features, and advantages of the present invention will become apparent from the following detailed description, the accompanying drawings, and the appended claims.

DETAILED DESCRIPTION OF THE PREFERRED EMBODIMENT

Referring to FIGS. 1 to 4 of the drawings, in a preferred embodiment of the present invention, the safety device comprises a shield 10, and a supporting frame 20. The shield 10 is fixed on the barrel 41 of the rifle 40 to protect the shooter's face as a face guard. The supporting frame 20 is adapted to support the shield 10 against the impact of a bullet shooting on the shield 10 or other attack.

Figure 1:
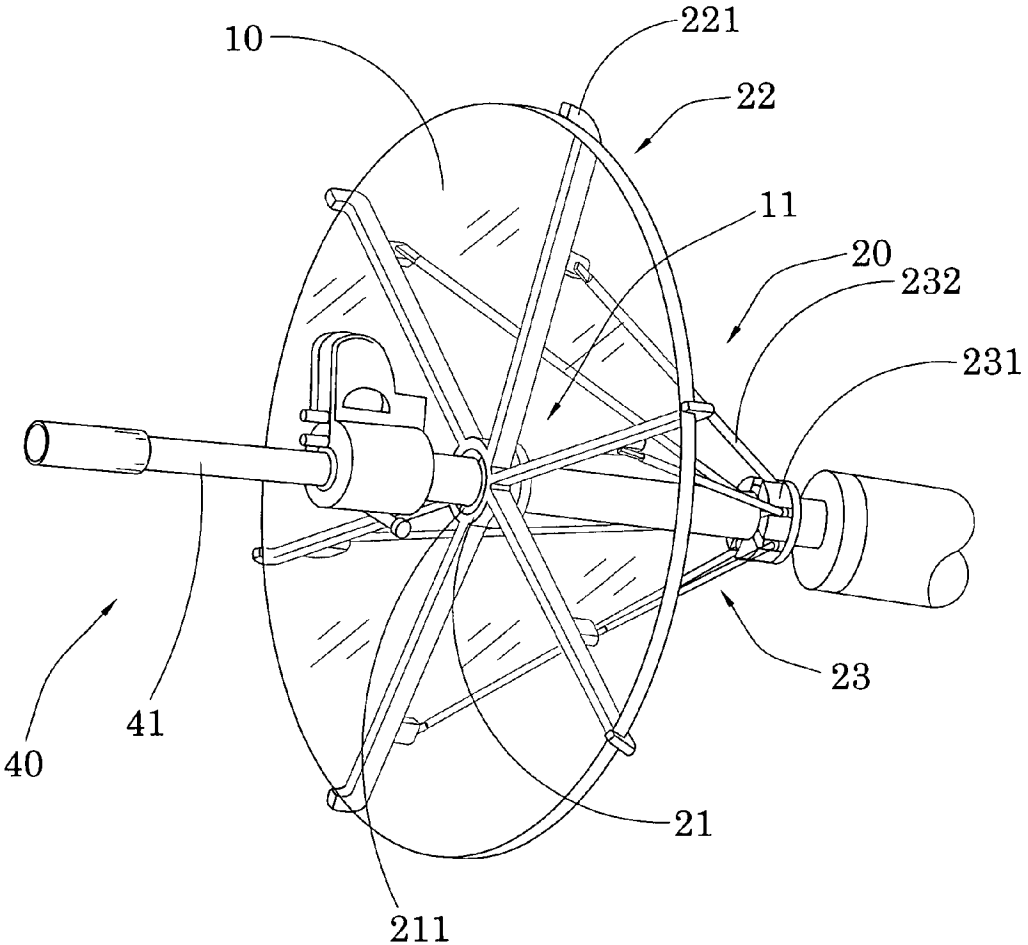
FIG. 1 is a perspective view of an embodiment of the present invention.

Referring to FIG. 1, in a preferred embodiment, the shield 10 is in a circular shape. The shield 10 has a through hole 11 in the center so the barrel 41 of a rifle 40 can pass through. In this way the shield 10 is sleeved over the barrel of the rifle 40 with the muzzle exposed to the target of the rifle 40. The shield 10 is made of transparent bulletproof material, such as bulletproof glass. The size is enough to cover the face of the shooter. So the shield 10 can protect the shooter, and at the same time, won't obstruct the view of the shooter for aiming and observing.

The supporting frame 20 comprises a hub locker 21 to detachably affix the supporting frame 20 over the barrel 41 of the rifle 40, and a shield supporter 22 which has a plurality of awning arms 221 mechanically and pivotally connected with the hub locker 21 and extend to the peripheral of the shield 10. In an embodiment of the present invention, the hub locker 21 is mounted on the through hole 11 of the shield 10, so it can be sleeve over the barrel 41 of the rifle 40. The hub locker 21 also has a deformable element 211 at the inner side there of. The deformable element 211 is made of flexible material; it can be deformed to fittingly match different shape of the rifles. The hub locker 21 can also be fixed and detached conveniently without any tool.

Figure 3:
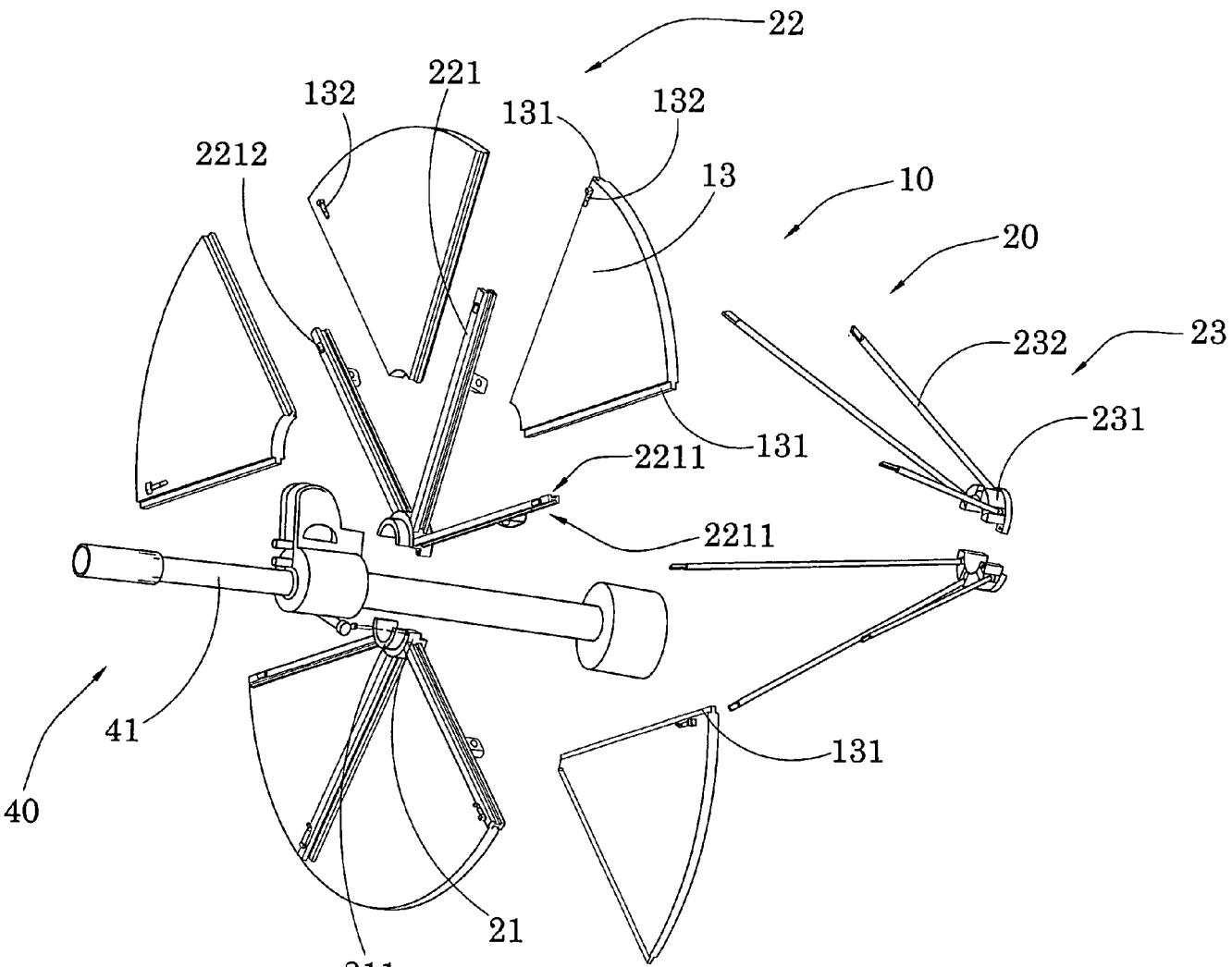
FIG. 3 is an explosive view of an embodiment of the present invention.

The shield supporter 22 is used to support the shield 10 against the impact of any attack towards the shooter. The awning arms 221 of the shield supporter 22 connected the shield 10 and the hub locker 21 to transfer the impact force to the barrel 41 of the rifle 40. Referring to FIG. 3, a plurality of awning arms 221 extends from the hub locker 21 to the peripheral of the shield 10. So the whole shield 10 is supported evenly.

Figure 4:
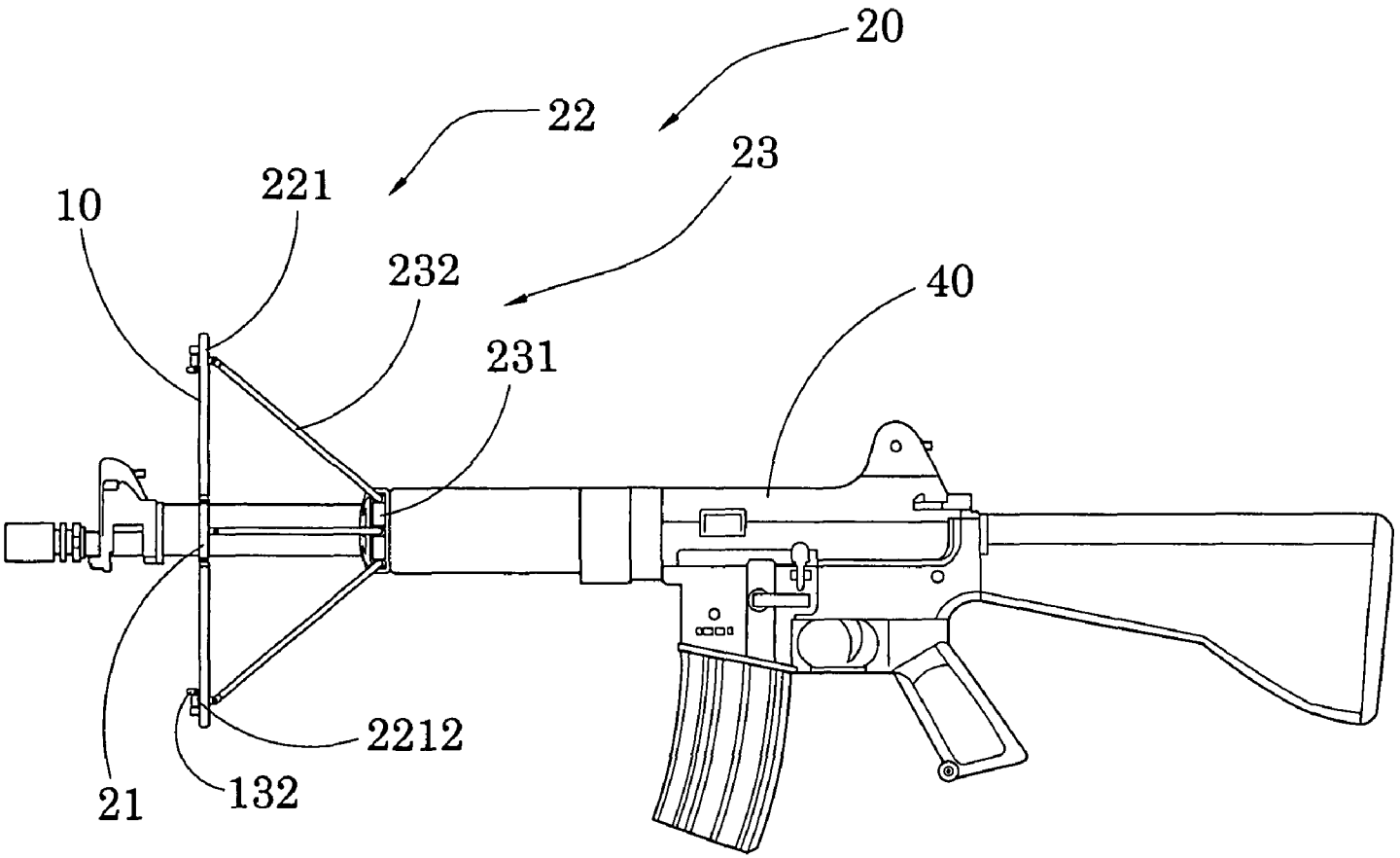
FIG. 4 is a side view of an alternative embodiment of the present invention.
Figure 5:
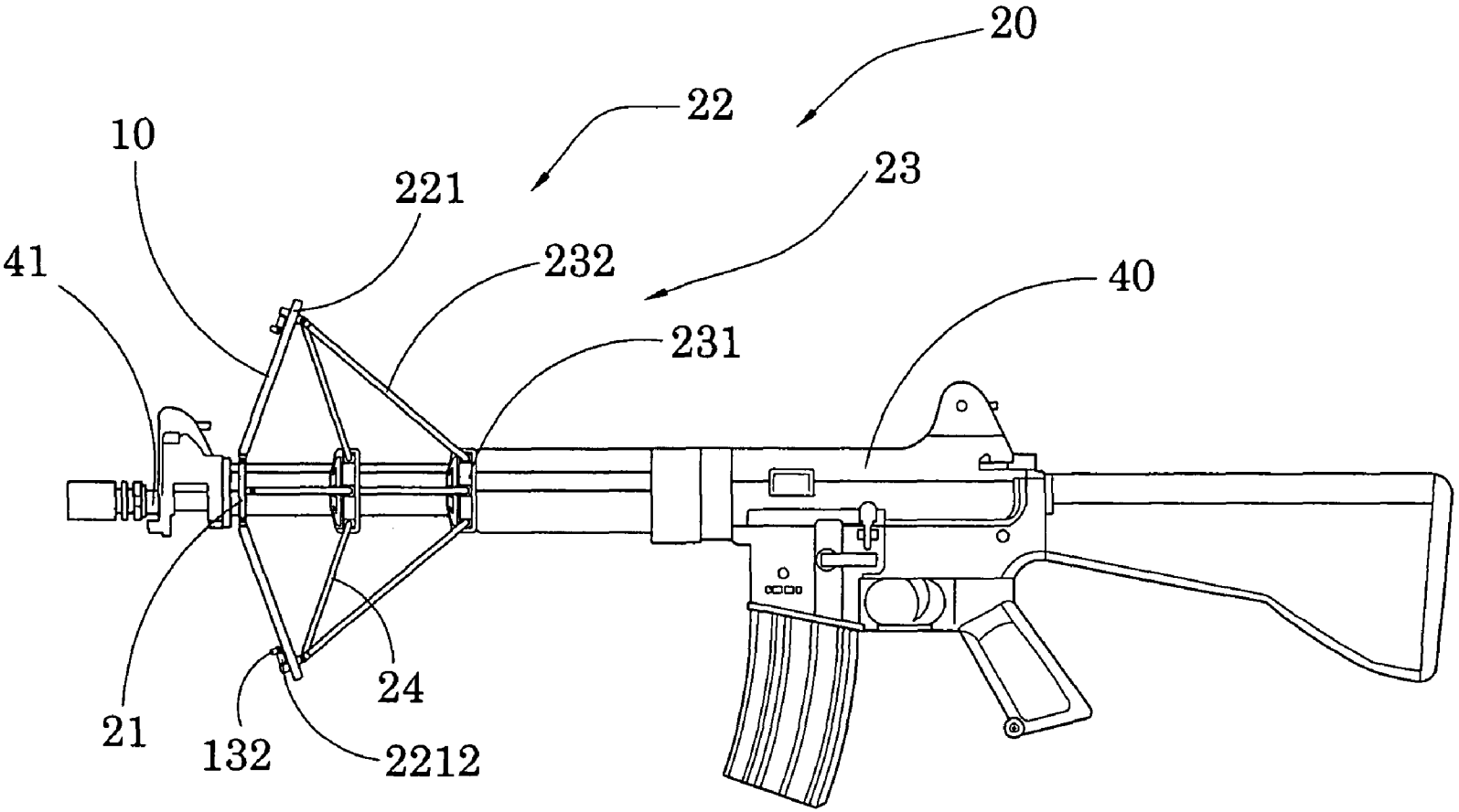
FIG. 5 is a side view of an alternative embodiment of the present invention.

Referring to FIG. 4, in a preferred embodiment, the shield 10 is perpendicular to the barrel of the rifle 40. The shield 10 is a flat disk. Referring to FIG. 5, in an alternative embodiment, the shield 10 is conical. The surface of the shield 10 has an angle with the barrel. In this embodiment, if the bullet is shot from the front of the rifle 40, the slope of the shield 10 will largely reduce the impact and may reflect the bullet away. Also, the tilted shield 10 increases the thickness. The awning arms 221 are attached on the rear surface of the shield 10.

Referring to FIG. 3, in a preferred embodiment, the supporting frame 20 comprises a reinforcing frame 23 to reinforce the supporting frame 20. The reinforcing frame 23 is rearwardly extended from the shield supporter for coupling with the rifle to reinforce the shield supporter. It further comprises a reinforcing locker 231 which is detachably coupled with the barrel 41 of the rifle 40 at a position behind the hub locker 21, and a plurality of reinforcing arms 232 which is pivotally extended from the reinforcing locker 231 to the free ends of the awning arms 221 respectively to reinforce the awning arms.

Referring to FIG. 5, in an alternative embodiment, the supporting frame 20 further comprises a plurality of supporting arms 24. These supporting arms 24 are pivotally extended from the free ends of the awning arms 221 respectively for biasing against the barrel of said rifle so as to provide a supplemental reinforcement of the awning arms 221 to support the shield 10.

Figure 6:
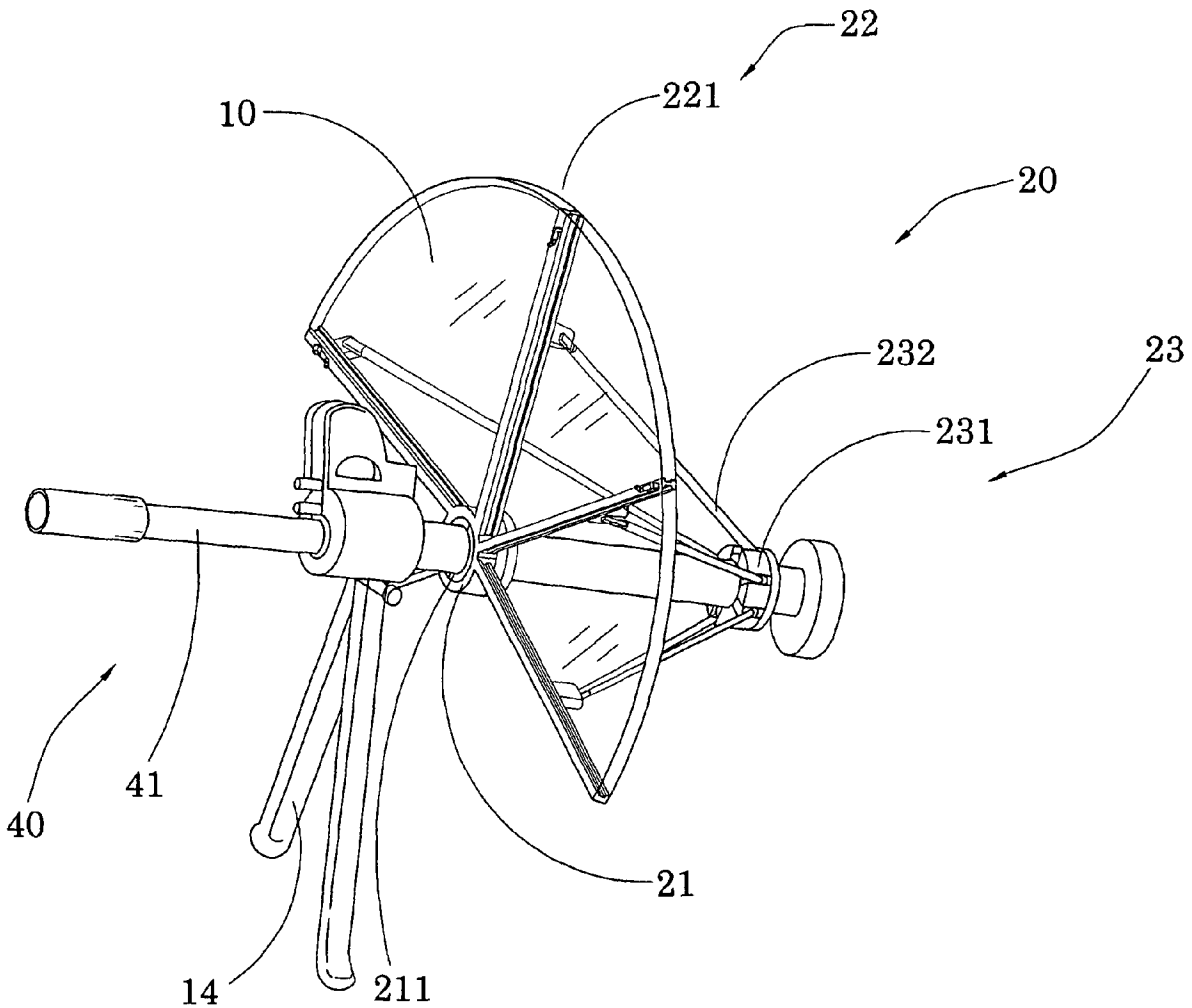
FIG. 6 is a perspective view of an alternative embodiment of the present invention.

Referring to FIG. 6, in an alternative embodiment, the shield 10 is a semi disk. Only the upper portion of the rifle 40 is covered by the shield 10, so the rifle 40 can be rest on the ground for shooting. In another alternative embodiment, the shield 10 also comprises a foldable bipod 14 to support the rifle 40 for a stable shooting. The shape of the shield 10 can be alternative for special requests.

Figure 2:
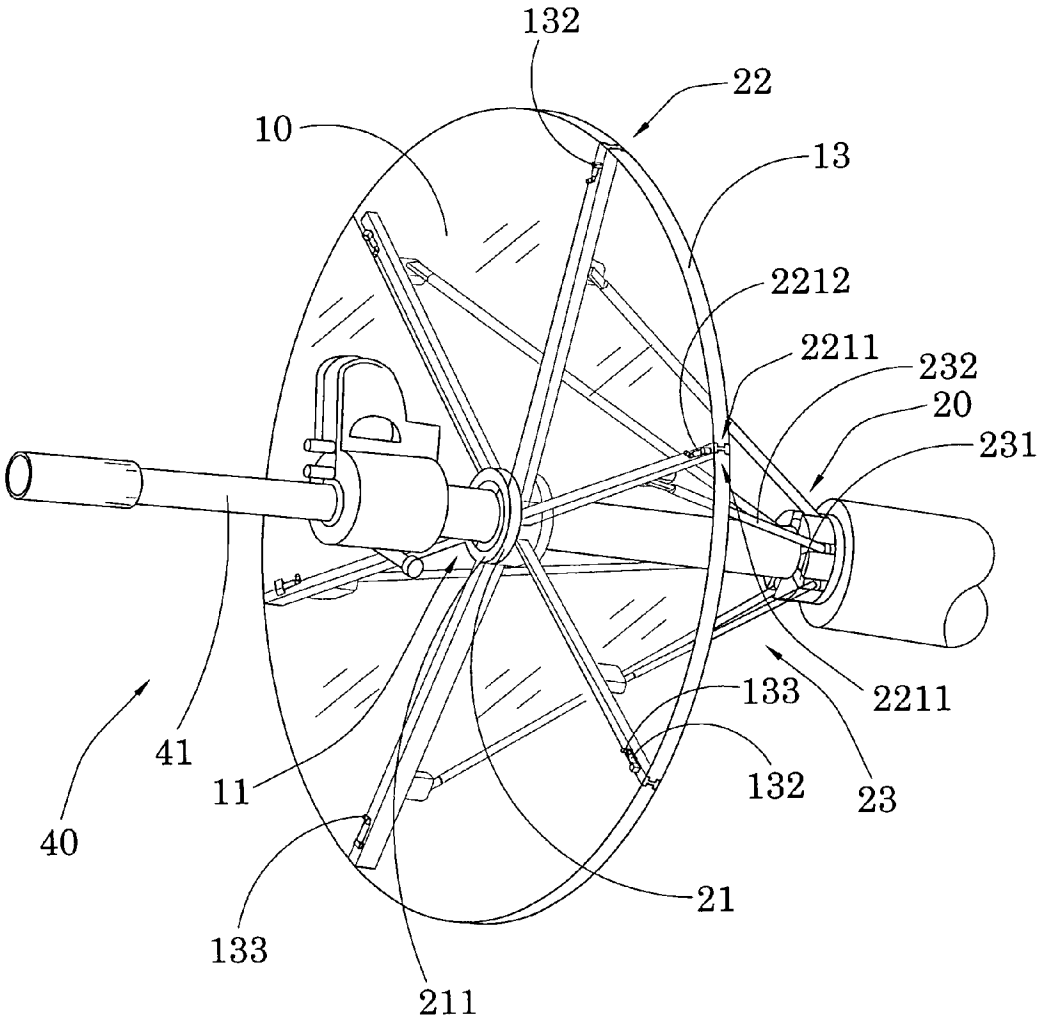
FIG. 2 is a perspective view of an alternative embodiment of the present invention.

Referring to FIG. 2, in another alternative embedment, the shield 10 comprises a plurality of shield sectors 13. These shield sectors are detachably coupled with the awning arms of the supporting frame 20 to form the shield 10. So the shield sectors 13 can be selectively assemble to form different shape for best perform, for example, to form a semi circular to protect the upper level of the rifle 40. Referring to FIG. 2, in a preferred embedment, each shield sector 13 of the shield 10 comprises two protruding ridges 131 on the two edges thereof. Correspondingly, each awning arm 221 of the supporting frame 20 comprises two slots 2211 on both sides thereof. The protruding ridges 131 of the shield sectors 13 can be selectively plugged into the corresponding slots 2211 of the awning arms 221 to form a shield. In order to securely couple the shield sectors 13 and the awning arms 221, the awning arm 221 further comprises one or more first tubular couplers 2212 thereon, and the shield sector 13 further comprises one or more second plugging couplers 132 protruding from the edge thereof correspondingly. When the shield sectors 13 is coupled with the awning arms 221, the second plugging couplers 132 are plugged into the first tubular couplers 2212 to securely couple the shield sectors 13 and the awning arms 221 together. The second plugging coupler 132 also has a stopper 133 extending out of the first tubular coupler 2212 at the end thereof. When the stopper 133 is bent perpendicularly to the second plugging coupler 132, the coupling of the first tubular coupler 2212 and the second plugging coupler 132 are secured.

Figure 7:
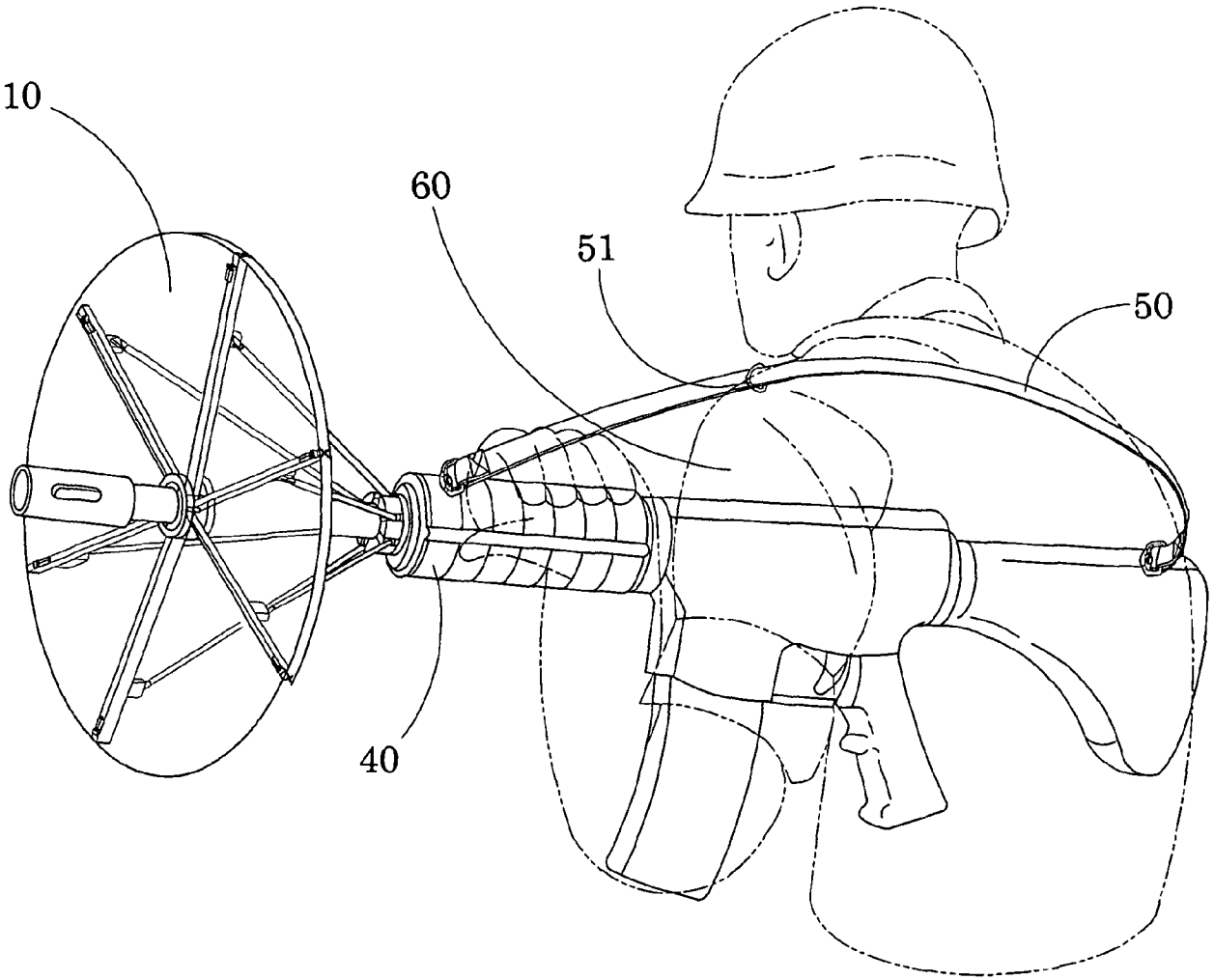
FIG. 7 is a perspective view of an alternative embodiment of the present invention.

Referring to FIG. 7, since the shield 10 adds extra weight on the front porting of the rifle 40, and moves the weight point forward, when the user carries the rifle 40 with a belt 50, the belt will slide around the shoulder of the user. In order to prevent the sliding, the present invention also comprises a belt holder 51 to attach the belt 50 on the shoulder of the uniform 60 of the user. The belt holder 51 could be a button, a hood-loop fastener, or other similar fasteners.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A safety device for a rifle having a barrel, comprising:

a shield, which is made of transparent bulletproof material, having a shielding area adapted for covering at least a face portion of a shooter and comprising a plurality of shield sectors; and a supporting frame which is arranged to support said shield, and comprises:

a hub locker adapted for mounting on said barrel of said rifle; and a shield supporter comprising a plurality of awning arms radially extended from said hub locker to support said shield around said barrel of said rifle and to form a face guard for said shooter during a shooting operation so that said shooter is able to conveniently carry said rifle with said shield and to see through said shield for aiming a target, wherein said shield sectors are detachably coupled with said awning arms to form a circular structure around said barrel of said rifle, wherein said supporting frame further comprises a reinforcing frame rearwardly extended from said shield supporter for coupling with said rifle to reinforce said shield supporter, wherein said reinforcing frame comprises a reinforcing locker adapted for detachably coupling with said barrel of said rifle at a position behind said hub locker, and a plurality of reinforcing arms movably extended from said reinforcing locker to connect with said awning arms respectively so as to reinforce said awning arms.

2. The safety device, as recited in claim 1, wherein said supporting frame further comprises a plurality of supporting arms pivotally extended from said awning arms respectively for biasing against said barrel of said rifle so as to provide a supplemental reinforcement of said awning arms to support said shield.

3. The safety device, as recited in claim 2, wherein said hub locker comprises a locking ring coaxially and detachably mounting at said barrel of said rifle and a ring-shaped deformable element provided at an inner side of said locking ring for biasing against an outer surface of said barrel, such that when said locking ring is detachably mounted at said barrel of said rifle, said deformable element is self-deformed for fittingly matching with a shape of said barrel of said rifle so as to securely lock up said hub locker at said barrel of said rifle.

4. The safety device, as recited in claim 2, wherein said shield has a circular shape and has a center through hole for said hub locker mounting thereto so as to coaxially support said shield with respect to said barrel of said rifle.

5. The safety device, as recited in claim 3, wherein said shield has a circular shape and has a center through hole for said hub locker mounting thereto so as to coaxially support said shield with respect to said barrel of said rifle.

6. The safety device, as recited in claim 4, wherein said awning arms are mechanically coupled with said hub locker in such a manner that said awning arms are capable of rearwardly folding along said barrel of said rifle in an axially manner.

7. The safety device, as recited in claim 5, wherein said awning arms are mechanically coupled with said hub locker in such a manner that said awning arms are capable of rearwardly folding along said barrel of said rifle in an axially manner.

8. The safety device, as recited in claim 6, wherein each of said shield sectors comprises two protruding ridges formed on two edges thereof, wherein each of said awning arms comprises two slots on both sides thereof, wherein said protruding ridges of said shield sectors are selectively plugged into said corresponding slots of said awning arms to form a shield.

9. The safety device, as recited in claim 7, wherein each of said shield sectors comprises two protruding ridges formed on two edges thereof, wherein each of said awning arms comprises two slots on both sides thereof, wherein said protruding ridges of said shield sectors are selectively plugged into said corresponding slots of said awning arms to form a shield.

10. The safety device, as recited in claim 8, wherein each of said shield sector further comprises at least one second plugging coupler, wherein each of said awning arms comprises at least one first tubular coupler, wherein said first tubular coupler and said second plugging coupler are coupled to secure said coupling of said shield sectors with said awning arms.

11. The safety device, as recited in claim 9, wherein each of said shield sector further comprises at least one second plugging coupler, wherein each of said awning arms comprises at least one first tubular coupler, wherein said first tubular coupler and said second plugging coupler are coupled to secure said coupling of said shield sectors with said awning arms.

* * * * *